US006285837B1

(12) United States Patent
Budnik et al.

(10) Patent No.: US 6,285,837 B1
(45) Date of Patent: Sep. 4, 2001

(54) SYSTEM FOR DETERMINING DEVELOPMENT GAP WIDTH IN A XEROGRAPHIC DEVELOPMENT SYSTEM USING AN AC FIELD

(75) Inventors: Roger W. Budnik, Rochester; James M. Pacer, Webster; Scott L. Kauffman; Richard M. Maier, both of Rochester; Michael G. Swales, Sodus, all of NY (US)

(73) Assignee: Xerox Corporation, Stamford, CT (US)

( * ) Notice: Subject to any disclaimer, the term of this patent is extended or adjusted under 35 U.S.C. 154(b) by 0 days.

(21) Appl. No.: 09/669,109

(22) Filed: Sep. 25, 2000

(51) Int. Cl.[7] ..... G03L 15/08
(52) U.S. Cl. ..... 399/31; 399/53
(58) Field of Search ..... 399/53, 55, 9, 399/31, 119, 126; 73/1.81; 324/71.1

(56) References Cited

U.S. PATENT DOCUMENTS 4,610,531 9/1986 Hayashi et al. ..... 355/14
5,402,214 3/1995 Henderson ..... 355/246
5,890,042 3/1999 Wong et al. ..... 399/285

FOREIGN PATENT DOCUMENTS 4-350864 * 12/1992 (JP) .
8-286509 * 11/1996 (JP) .
2001-27838 * 1/2001 (JP) .

* cited by examiner

*Primary Examiner*—Joan Pendegrass
(74) *Attorney, Agent, or Firm*—R. Hutter

(57) ABSTRACT

In a xerographic development system in which an AC field is set up in a gap between a donor member and the photoreceptor to develop an electrostatic latent image, a series of tests are performed to ascertain that the width of the gap is within a suitable range. In test mode, various DC and AC biases associated with the field are systematically altered, and the reflectivities of resulting test images are read. Based on these reflectivity readings, it can be determined if the gap is too wide, such as to cause poor print quality, or too narrow, such as to cause arcing.

7 Claims, 3 Drawing Sheets

SYSTEM FOR DETERMINING DEVELOPMENT GAP WIDTH IN A XEROGRAPHIC DEVELOPMENT SYSTEM USING AN AC FIELD

FIELD OF THE INVENTION

This invention relates generally to a development system as used in xerography, and more particularly concerns a "jumping" development system in which toner is conveyed to an electrostatic latent image by an AC field.

BACKGROUND OF THE INVENTION

In a typical electrostatographic printing process, such as xerography, a photoreceptor is charged to a substantially uniform potential so as to sensitize the surface thereof. The charged portion of the photoreceptor is exposed to a light image of an original document being reproduced. Exposure of the charged photoreceptor selectively dissipates the charges thereon in the irradiated areas. This records an electrostatic latent image on the photoreceptor corresponding to the informational areas contained within the original document. After the electrostatic latent image is recorded on the photoreceptor, the latent image is developed by bringing a developer material into contact therewith. Generally, the developer material comprises toner particles adhering triboelectrically to carrier granules. The toner particles are attracted from the carrier granules to the latent image forming a toner powder image on the photoreceptor. The toner powder image is then transferred from the photoreceptor to a copy sheet. The toner particles are heated to permanently affix the powder image to the copy sheet. After each transfer process, the toner remaining on the photoconductor is cleaned by a cleaning device.

One specific type of development apparatus currently used in high-quality xerography is known as a hybrid jumping development (HJD) system. In the HJD system, a layer of toner is laid down evenly on the surface of a "donor roll" which is disposed near the surface of the photoreceptor. Biases placed on the donor roll create two development fields, or potentials, across the gap between the donor roll and the photoreceptor. The action of these fields causes toner particles on the donor roll surface to form a "toner cloud" in the gap, and the toner in this cloud thus becomes available to attach to appropriately-charged image areas on the photoreceptor.

In a practical application of hybrid jumping development, a crucial parameter for the quality of the resulting images is the width of the gap between of the donor roll and the photoreceptor. If the width of the gap is too large, noticeable defects in image quality will result. If the gap is too small, there is likely to be arcing between the donor roll and the photoreceptor, which is of course unacceptable. Unfortunately, with the desirable modular design of office equipment, this crucial gap width is hard to control if the module including the donor roll is separate from another module including the photoreceptor. Whenever one or the other module is replaced, the gap width is likely to change. It is therefore desirable to have a testing method, which can be automated by software within the printer, which can ascertain that the gap width is within an acceptable range.

DESCRIPTION OF THE PRIOR ART

U.S. Pat. No. 4,610,531 discloses the basic concept of jumping development with an AC field set up between a donor member and a photoreceptor.

U.S. Pat. No. 5,402,214 discloses a control system for a xerographic printing system in which the reflectivity of a test patch is measured, and the DC bias of a field associated with the development unit is adjusted accordingly.

U.S. Pat. No. 5,890,042 discloses a hybrid jumping development system, in which a donor roll is loaded with a layer of toner particles by a magnetic roll which conveys toner which adheres to carrier granules.

SUMMARY OF THE INVENTION

In accordance with the present invention, there is provided, in an electrostatographic development system wherein toner is conveyed from a donor member over a development gap to a charge receptor by an AC development field in the development gap, a method comprising the following steps. An image of a predetermined type is developed with the AC field being set to default parameters, and reading a reflectivity of the developed image. In a first test, an image of the predetermined type is developed with the AC field being set a different amplitude relative to the default parameters, and a reflectivity of the developed image is read to yield a first test result. Based on at least the first test result, it is determined whether a width of the development gap is within a predetermined range.

DETAILED DESCRIPTION OF THE INVENTION

Figure 1:
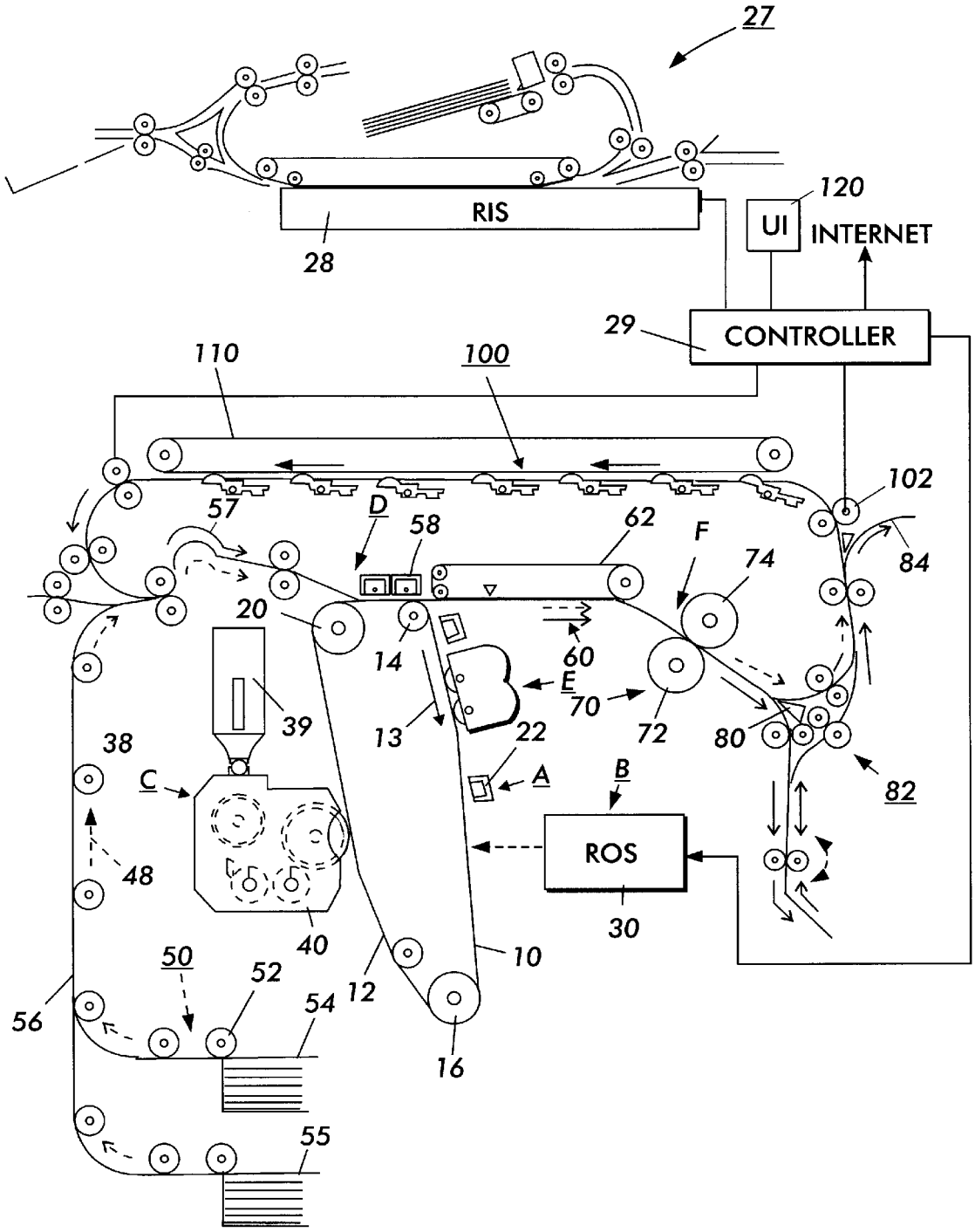
FIG. 1 PRIOR ART
FIG. 1 is a schematic elevational view of a typical electrophotographic printing machine utilizing the toner maintenance system therein.

For a general understanding of the features of the present invention, reference is made to the drawings. In the drawings, like reference numerals have been used throughout to identify identical elements. FIG. 1 schematically depicts an electrophotographic printing machine incorporating the features of the present invention therein. It will become evident from the following discussion that the development system of the present invention may be employed in a wide variety of devices and is not specifically limited in its application to the particular embodiment depicted herein.

Referring to FIG. 1 of the drawings, an original document is positioned in a document handler 27 on a raster input scanner (RIS) indicated generally by reference numeral 28. The RIS contains document illumination lamps, optics, a mechanical scanning drive and a photosensor array. The RIS captures the entire original document and converts it to a series of raster scan lines. This information is transmitted to an electronic subsystem (ESS) which controls a raster output scanner (ROS) described below.

FIG. 1 schematically illustrates an electrophotographic printing machine which generally employs a photoreceptor belt 10. Preferably, the photoreceptor belt 10 is made from a photoconductive material, forming a photoconductive surface 12, coated on a ground layer, which, in turn, is coated on an anti-curl backing layer. Belt 10 moves in the direction of arrow 13 to advance successive portions sequentially through the various processing stations disposed about the path of movement thereof. Belt 10 is entrained about stripping roll 14, tensioning roll 16 and drive roll 20. As roll 20 rotates, it advances belt 10 in the direction of arrow 13.

Initially, a portion of the photoconductive surface passes through charging station A. At charging station A, a corona generating device indicated generally by the reference numeral 22 charges the photoreceptor 10 to a relatively high, substantially uniform potential.

At an exposure station B, a controller or electronic subsystem (ESS), indicated generally by reference numeral 29, receives the image signals representing the desired output image and processes these signals to convert them to a continuous tone or grayscale rendition of the image which is transmitted to a modulated output generator, for example the raster output scanner (ROS), indicated generally by reference numeral 30. Preferably, ESS 29 is a self-contained, dedicated minicomputer. The image signals transmitted to ESS 29 may originate from a RIS as described above or from a computer, thereby enabling the electrophotographic printing machine to serve as a remotely located printer for one or more computers. Alternatively, the printer may serve as a dedicated printer for a high-speed computer. The signals from ESS 29, corresponding to the continuous tone image desired to be reproduced by the printing machine, are transmitted to ROS 30. ROS 30 includes a laser with rotating polygon mirror blocks. The ROS will expose the photoreceptor 10 to record an electrostatic latent image thereon corresponding to the continuous tone image received from ESS 29. As an alternative, ROS 30 may employ a linear array of light emitting diodes (LEDs) arranged to illuminate the charged portion of photoreceptor 10 on a raster-by-raster basis.

After the electrostatic latent image has been recorded on photoconductive surface 12, photoreceptor 10 advances the latent image to a development station, C, where toner, in the form of liquid or dry particles, is electrostatically attracted to the latent image using the device of the present invention as further described below. The latent image attracts toner particles from the carrier granules forming a toner powder image thereon. As successive electrostatic latent images are developed, toner particles are depleted from the developer material. A toner particle dispenser, indicated generally by the reference numeral 39, on signal from controller 29, dispenses toner particles into developer housing 40 of developer unit 38 based on signals from a toner maintenance sensor (not shown).

With continued reference to FIG. 1, after the electrostatic latent image is developed, the toner powder image present on photoreceptor 10 advances to transfer station D. A print sheet 48 is advanced to the transfer station, D, by a sheet feeding apparatus, 50. Preferably, sheet feeding apparatus 50 includes a feed roll 52 contacting the uppermost sheet of stack 54. Feed roll 52 rotates to advance the uppermost sheet from stack 54 into vertical transport 56. Vertical transport 56 directs the advancing sheet 48 of support material into registration transport 57 past image transfer station D to receive an image from photoreceptor 10 in a timed sequence so that the toner powder image formed thereon contacts the advancing sheet 48 at transfer station D. Transfer station D includes a corona generating device 58 which sprays ions onto the back side of sheet 48. This attracts the toner powder image from photoconductive surface 12 to sheet 48. After transfer, sheet 48 continues to move in the direction of arrow 60 by way of belt transport 62 which advances sheet 48 to fusing station F.

Fusing station F includes a fuser assembly indicated generally by the reference numeral 70 which permanently affixes the transferred toner powder image to the copy sheet. Preferably, fuser assembly 70 includes a heated fuser roll 72 and a pressure roll 74 with the powder image on the copy sheet contacting fuser roll 72.

The sheet then passes through fuser 70 where the image is permanently fixed or fused to the sheet. After passing through fuser 70, a gate 80 either allows the sheet to move directly via output 84 to a finisher or stacker, or deflects the sheet into the duplex path 100, specifically, first into single sheet inverter 82 here. That is, if the sheet is either a simplex sheet, or a completed duplex sheet having both side one and side two images formed thereon, the sheet will be conveyed via gate 80 directly to output 84. However, if the sheet is being duplexed and is then only printed with a side one image, the gate 80 will be positioned to deflect that sheet into the inverter 82 and into the duplex loop path 100, where that sheet will be inverted and then fed for recirculation back through transfer station D and fuser 70 for receiving and permanently fixing the side two image to the backside of that duplex sheet, before it exits via exit path 84.

After the print sheet is separated from photoconductive surface 12 of photoreceptor 10, the residual toner/developer and paper fiber particles adhering to photoconductive surface 12 are removed therefrom at cleaning station E. Cleaning station E includes a rotatably mounted fibrous brush in contact with photoconductive surface 12 to disturb and remove paper fibers and a cleaning blade to remove the nontransferred toner particles. The blade may be configured in either a wiper or doctor position depending on the application. Subsequent to cleaning, a discharge lamp (not shown) floods photoconductive surface 12 with light to dissipate any residual electrostatic charge remaining thereon prior to the charging thereof for the next successive imaging cycle.

The various machine functions are regulated by controller 29. The controller is preferably a programmable microprocessor which controls all of the machine functions hereinbefore described. The control of all of the exemplary systems heretofore described may be accomplished by conventional control switch inputs from the printing machine consoles selected by the operator.

Figure 2:
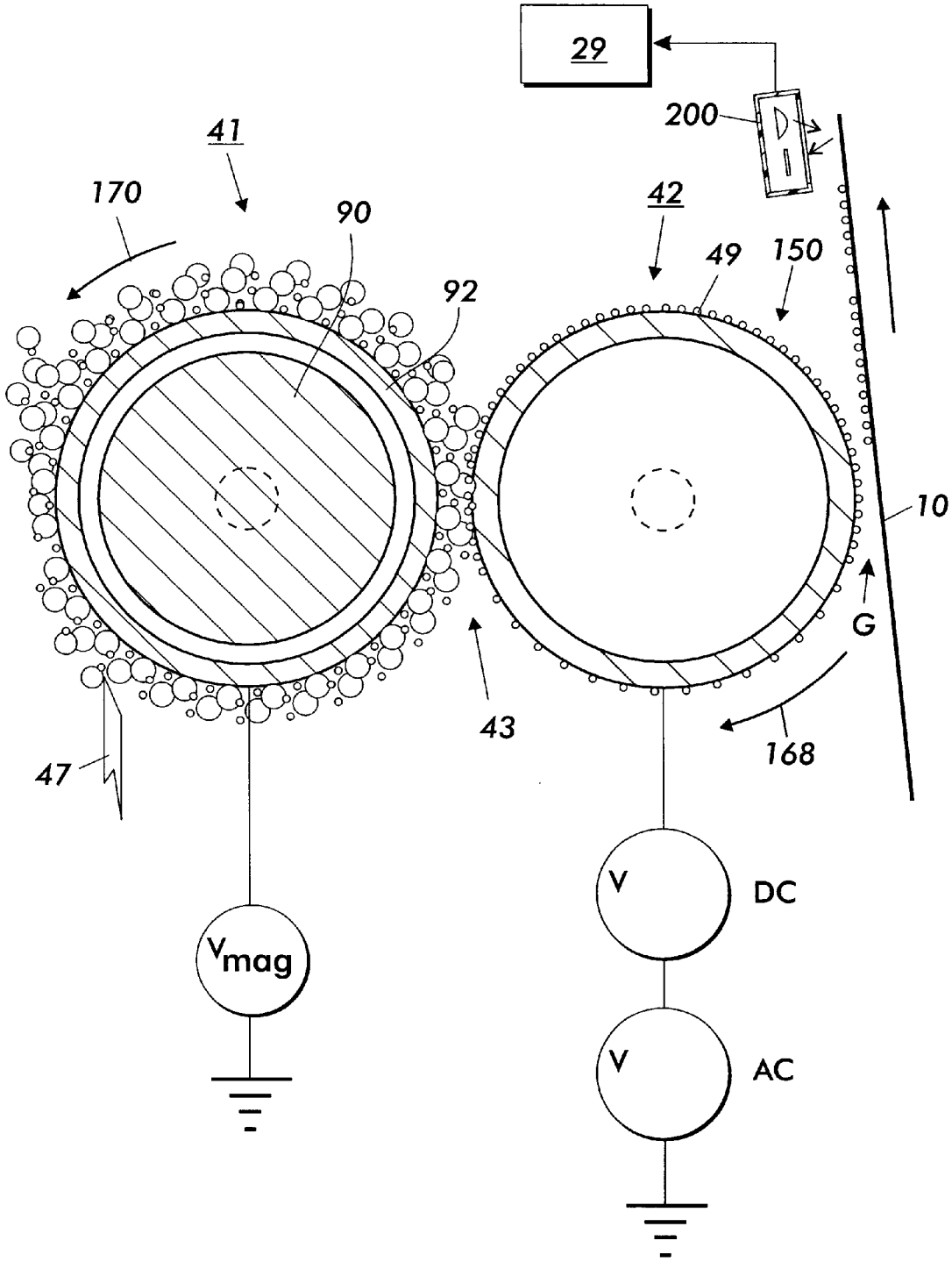
FIG. 2 is a schematic elevational view of the development system utilizing the invention herein.

Turning now to FIG. 2, there is shown development system 38 in greater detail. More specifically, a hybrid development system is shown where toner is loaded onto a donor roll from a second roll, e.g. a magnetic brush roll. The toner is developed onto the photoreceptor from the donor roll using the hybrid jumping development system (HJD) described below. As shown thereat, development system 38 includes a housing 40 defining a chamber for storing a supply of developer material therein. Donor roll 42 and magnetic roll 41 are mounted in chamber of housing 40. The donor roll 42 can be rotated in either the 'with' or 'against' direction relative to the direction of motion of the photoreceptor 10.

In FIG. 2, donor roll 42 is shown rotating in the direction of arrow 168, i.e. the against direction. Similarly, the magnetic roll 41 can be rotated in either the 'with' or 'against' direction relative to the direction of motion of donor roll 42. In FIG. 2, magnetic roll 41 is shown rotating in the direction of arrow 170 i.e. the with direction. Donor roll 42 is preferably made from a conductive core which may be a metallic material with a semi-conductive coating such as a phenolic resin or ceramic.

Magnetic roll 41 meters a constant quantity of toner having a substantially constant charge onto donor roll 42. This ensures that the donor roll provides a constant amount of toner having a substantially constant charge as maintained by the present invention in the development gap. Metering blade 47 is positioned closely adjacent to magnetic roll 41 to maintain the compressed pile height of the developer material on magnetic roll 41 at the desired level. Magnetic roll 41 includes a non-magnetic tubular member 92 made preferably from aluminum and having the exterior circumferential surface thereof roughened. An elongated magnet 90 is positioned interiorly of and spaced from the tubular member. The magnet is mounted stationarily. The tubular member rotates in the direction of arrow 170 to advance the developer material adhering thereto into the nip 43 defined by donor roll 42 and magnetic roll 41. Toner particles are attracted from the carrier granules on the magnetic roll to the donor roll.

Further as shown in FIG. 2, the magnetic roll 41 and the donor roll 42 are respectively biased in order to convey toner particles from a magnetic roll 41 to donor roll 42, and then across the gap, indicated as 200, between of the donor roll 42 and it the surface of photoreceptor 10. With regard to magnetic roll 41, the bias on the roll is indicated as Vmag, which is a simple DC bias. Donor roll 42 is, in turn, biased with both a DC bias, indicated as Vdonor, and a superimposed AC bias, indicated as Vjump. (The photoreceptor 10 is typically connected to ground, such as through a backer bar, not shown, in contact therewith.) The AC on the donor roll 42 ultimately causes the toner layer on the donor roll 42 to form a "cloud" of toner near the gap between the donor roll 42 and the photoreceptor 10: in this way, the free toner particles in the cloud can attach to appropriately-charged image areas on the photoreceptor 10.

Figure 3:
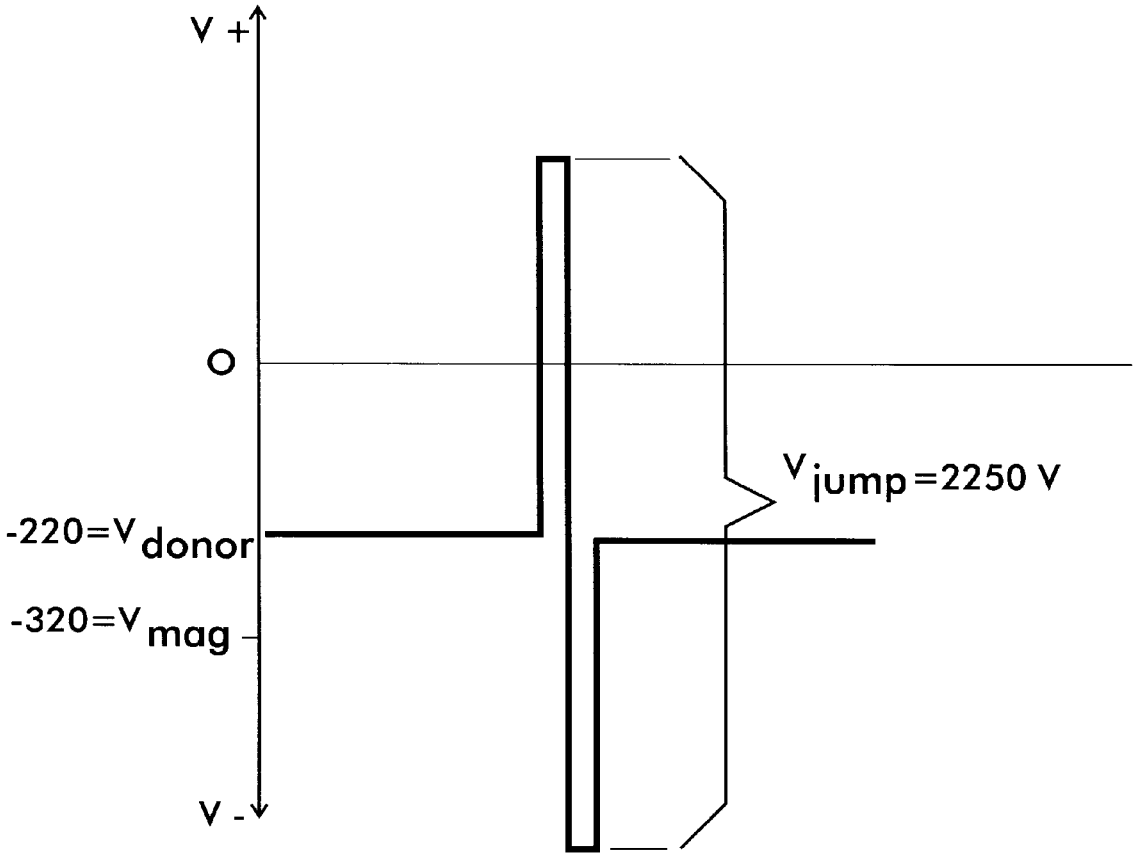
FIG. 3 a is diagram showing the biases of various elements in a development system.

FIG. 3 is a diagram showing the relative biases on magnetic roll 41 and donor roll 42 for a typical practical embodiment of a xerographic printer. This practical embodiment will further be discussed with specific reference to the claimed invention, but of course the basic principles shown and claimed herein will apply to any applicable machine design. In this embodiment, for normal operation, the DC bias on the donor roll 42, Vdonor, is −220 VDC. Riding on this DC bias on the donor roll 42 is an AC square wave with an amplitude (top to bottom), Vjump, of 2250V: clearly, a portion of the total bias on donor roll 42 will enter positive polarity, as shown. (A typical frequency of the square wave is about 3.25 kHz.) Magnetic roll 41, under normal conditions, is biased to −113 VDC, shown as Vmag.

As mentioned above, a crucial parameter for the quality of the resulting images is the width of the gap between of the donor roll and the photoreceptor. If the width of the gap is too large, noticeable defects in image quality will result. If the gap is too small, there is likely to be arcing between the donor roll and the photoreceptor, which is of course unacceptable. Unfortunately, with the desirable modular design of office equipment, this crucial gap width is hard to control if the module including the donor roll is separate from another module including the photoreceptor. Whenever one or the other module is replaced, the gap width is likely to change. It is therefore necessary to have a testing method, which can be automated by software within the printer, which can ascertain that the gap width is within an acceptable range.

Specifically, according to a preferred embodiment of the present invention, there is provided a step-by-step method for determining if the width of the gap is within a suitable range, comprising a series of deliberate manipulations of the biases on magnetic roll 41 and donor roll 42 followed by readings of actual reflectivities from a deliberately-created test patch on photoreceptor 10, as measured by a standard reflectometer 200 placed downstream of the gap. Certain combinations of results from each of the series of tests will be specifically indicative of the gap being either too small or too large.

The following list describes the most effective series of tests known to the inventors as of the filing hereof, for an electrophotographic printer of the general design described above. With each test, the ROS in the printer creates a test patch of a known desired density (such as an 87.5% halftone screen) on the belt 10 at a location where the patch can be measured by reflectometer 200 following development with toner. For purposes of the below discussion, the "result" of each test is a numerical output from reflectometer 200: under the convention herein, the larger the numerical output, the lighter (less toner) the developed test patch. The outputs from reflectometer 200 are in turn sent to controller 29, as shown.

This is the sequence of tests, each followed by a reflectometer reading of the resulting test patch:

Test #1: all biases (Vmag, Vdonor, Vjump) set to normal values (see above)

Test #2: amplitude of Vjump decreased by 100 volts peak to peak

Test #3: amplitude of Vjump increased by 100 volts peak to peak

Test #4: Vmag set to normal, increased (in absolute terms) by 50 volts (in this example, changed from −320 volts to −370 volts)

Test #5: Vdonor set to normal, decreased (in absolute terms) by 100 volts (in this example, Vdonor is changed from −220 volts to −120 volts; the value of Vmag, which is tied to Vdonor in one practical embodiment, is simultaneously changed from −320 volts to −220 volts)

Following these tests and the corresponding reflectometer readings, the following analysis is made (the numbers associated with the results are reflectometer readings, with a higher number meaning a lighter patch):

IF (test #3<test #2) AND (test #421 test #1) AND (test #1<test #5) AND (test #5>a constant value which is significantly higher than the expected default result) THEN the gap is too wide.

IF (test #2<test #5) OR (test #2<test #3) THEN the gap is too narrow.

If either the too-wide or too-narrow conditions are determined, then the machine as a whole is preferably stopped, and an appropriate notification is made, either through the user display 120 on the machine and/or through a modem or internet connection to a service organization.

To summarize briefly the overall purposes of the above tests, it can be seen that test #1, the default state, is used as a "control" to determine the test patch density under conditions which would be used to output prints. Test #2 and test #3 can be seen as experiments with higher and lower amplitudes of the AC bias on donor roll 42: in short, a lower amplitude (test #2) should make the patch lighter and a higher amplitude should make the patch darker, if the gap is in the correct range. Test #4 and test #5 both relate to increasing (in absolute terms) the relative bias on donor roll 42. The increase in Vmag in test #4 should result in a darker patch, while the negative increase in Vdonor in test #5 should result in a lighter patch. By various combinations of these tests, such as in the preferred embodiment, the isolation of the gap width (too wide or too narrow) as the single "bad parameter" can be performed in a hands-free manner, by internal software within the machine, or alternately over an internet connection.

Another key aspect of the present invention is the fact that the above-described tests to determine if the width of the gap is in within a suitable range can be initiated and controlled by a host computer which is remote from the printer or copier itself; in this way a maintenance program controlled by a vendor or support organization can test the gap width in response to a general customer complaint about machine performance. In such an arrangement, the host computer can contact a particular machine over the internet, accessing controller 29 as shown in FIG. 1, and cause the machine to carry out the above tests and report back the patch test results and/or the analysis over the internet (the analysis of the test patch results can occur either at the machine or at the host computer). In this way, a machine can be remotely checked to determine that the development gap therein is within a suitable range, which in practical terms essentially means that the various modules within the machine have been correctly installed. If it is determined that the gap is not within a suitable range, an indication to this effect can be displayed to a user or on-the-scene service personnel through user interface 120 shown in FIG. 1 (and, of course, the testing itself can be initiated through user interface 120 as well), and/or communicated to a remote host computer through the internet, phone modem (not shown) or other medium.

What is claimed is:

1. In an electrostatographic development system wherein toner is conveyed from a donor member over a development gap to a charge receptor by an AC development field in the development gap, a method comprising the steps of:

developing an image of a predetermined type with the AC field being set to default parameters, and reading a reflectivity of the developed image;

in a first test, developing an image of the predetermined type with the AC field being set a different amplitude relative to the default parameters, and reading a reflectivity of the developed image, to yield a first test result; and determining, based on at least the first test result, whether a width of the development gap is within a predetermined range.

2. The method of claim 1, wherein the first test includes developing a first image of the predetermined type with the AC field being set a greater amplitude relative to the default parameters, reading a reflectivity of the developed first image, developing a second image of the predetermined type with the AC field being set a smaller amplitude relative to the default parameters, and reading a reflectivity of the second developed image.

3. The method of claim 1, further comprising the steps of in a second test, developing an image of a predetermined type with a DC bias of the AC field being set to a different bias relative to the default parameters, and reading a reflectivity of the developed image, to yield a second test result; and determining, based on at least the first test result and the second test result, whether a width of the development gap is within a predetermined range.

4. The method of claim 3, wherein the first test includes developing a first image of the predetermined type with the AC field being set a smaller amplitude relative to the default parameters, and reading a reflectivity of the first developed image, and the second test includes developing a second image of the predetermined type with a DC bias of the AC field being set at a greater absolute value relative to the default parameters, and reading a reflectivity of the second developed image; and further comprising the step of determining that the width of the development gap is not within the predetermined range if the first developed image is darker than the second developed image.

5. The method of claim 1, wherein the apparatus further comprises a magnetic roll for loading toner onto the donor member, the magnetic roll being biased to a default bias as a default parameter, and further comprising the steps of in a third test, developing an image of the predetermined type while biasing the magnetic roll to a greater bias in absolute terms relative to the default bias, and reading a reflectivity of the developed image, to yield a third test result; and determining, based on at least the first test result and the third test result, whether a width of the development gap is within a predetermined range.

6. The method of claim 1, further comprising the step of communicating whether a width of the development gap is within a predetermined range.

7. The method of claim 6, further comprising the step of communicating over the internet whether a width of the development gap is within a predetermined range.

* * * * *